US005303869A

United States Patent [19]

Hudson, Jr.

[11] Patent Number: 5,303,869

[45] Date of Patent: Apr. 19, 1994

[54] MULTIPLE NOZZLE ON A FLEXIBLE STRAP FOR A GARDEN SPRAYER

[75] Inventor: Robert C. Hudson, Jr., Northbrook, Ill.

[73] Assignee: H. D. Hudson Manufacturing Company, Chicago, Ill.

[21] Appl. No.: 94,373

[22] Filed: Jul. 19, 1993

[51] Int. Cl.[5] ..... B05B 1/00

[52] U.S. Cl. ..... 239/391; 239/390; 222/543

[58] Field of Search ..... 239/390, 391, DIG. 12, 239/392, 397, 396; 222/543, 575, 331

[56] References Cited

U.S. PATENT DOCUMENTS

| | | | |
|---|---|---|---|
| 2,790,680 | 4/1957 | Rosholt | 239/396 |
| 2,945,458 | 7/1960 | Setecka | 222/575 |
| 2,968,262 | 1/1961 | Lacey | 222/575 |
| 3,016,168 | 1/1962 | Larson | 222/543 |
| 3,022,955 | 2/1962 | Riddell . | |
| 3,191,809 | 6/1965 | Schultz et al. . | |
| 4,382,530 | 5/1983 | Calisto . | |
| 4,838,490 | 6/1989 | Nissels | 239/396 |
| 5,002,206 | 3/1991 | Allegretti et al. | 222/331 |

*Primary Examiner*—Andres Kashnikow
*Assistant Examiner*—Christopher G. Trainor
*Attorney, Agent, or Firm*—Kane, Dalsimer, Sullivan, Kurucz, Levy, Eisele & Richard

[57] ABSTRACT

A multiple nozzle and strap assembly is adapted to be coupled with a nozzle body of a sprayer. A strap has an opening for receiving the nozzle body and a nozzle for coupling with the nozzle body for obtaining a selected discharge pattern. Another strap can be provided with a different nozzle for obtaining another discharge pattern.

12 Claims, 3 Drawing Sheets

MULTIPLE NOZZLE ON A FLEXIBLE STRAP FOR A GARDEN SPRAYER

BACKGROUND OF THE INVENTION

Garden sprayers are typically employed in controlling insects, diseases and weeds and, at times, in supplying plant food and various additives to plants, shrubs, bushes and trees. Depending on the application, one may select from many different types and varieties of sprayers including compression sprayers, lever pump-up sprayers, barrel and bucket spray pumps, power sprayers, hand sprayers and many others. In all instances, a nozzle is employed to obtain the desired spray pattern. Some nozzles provide only a single spray pattern, other adjustable nozzles provide for multiple spray patterns. However, with respect to multiple spray nozzles, the selection of spray patterns has been limited for a single adjustable-nozzle. Where a wide range of discharge spray patterns are from time-to-time desired, one nozzle would have to be replaced with another. Obviously, individual detachable nozzles suffer the drawback of being misplaced, lost or simply not viable when its particular spray pattern is desired at a specific location or instance in time.

SUMMARY OF THE INVENTION

A principal object of the present invention is to provide multiple nozzles on a flexible strap adapted to be coupled with the discharge end of an extension tube extending from a sprayer.

Another object is to provide two or more nozzles integrally molded with a connecting flexible strap adapted to be coupled with the nozzle body at the distal end of an extension tube extending from a sprayer with the nozzles affording a wide range of discharge patterns.

Other objects and advantages will become apparent from the following detailed description which is to be taken in conjunction with the accompanying drawings.

DETAILED DESCRIPTION

Figure 1:
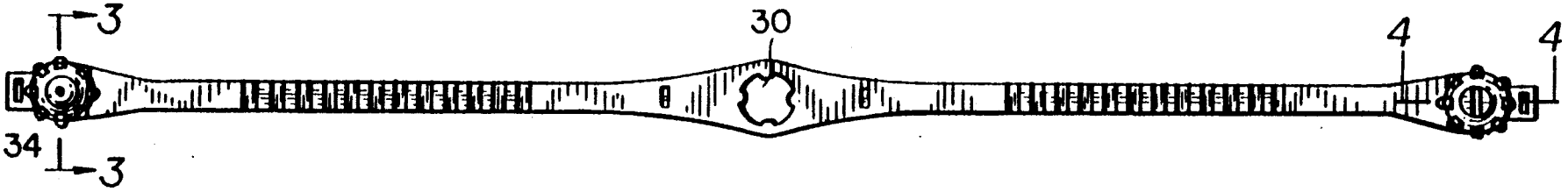
FIG. 1 is a top plain view of two different nozzles integrally molded with a connecting strap adapted to be coupled with a valve body.
Figure 2:
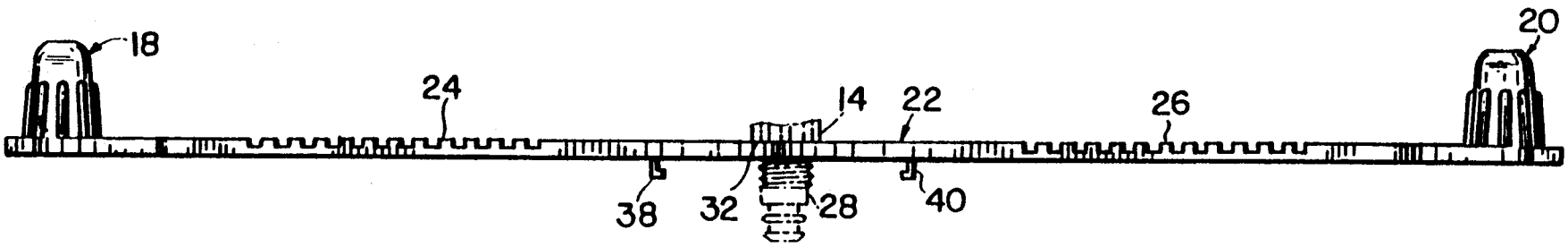
FIG. 2 is a side elevational view thereof with the nozzle body shown in phantom.
Figure 4:
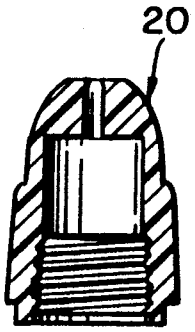
FIG. 4 is a longitudinal sectional view of another representative nozzle providing a flat fan discharge pattern usable with this invention and taken along the line 4—4 of FIG. 1.
Figure 3:
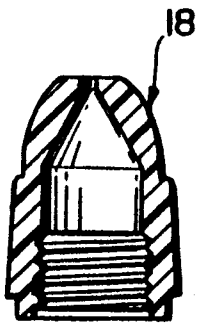
FIG. 3 is a longitudinal sectional view of a representative nozzle providing a cone discharge pattern usable with this invention and taken along the line 3—3 of FIG. 1.

In the drawings a multiple nozzle and strap assembly 10 is adapted to be mounted on the distal discharge end 12 of a tube extension 14 extending from a sprayer 16 which, as shown, may be of the compression sprayer variety but it should be understood other types of sprayers could be used equally as well. The assembly 10 includes nozzles 18 and 20 and integrally molded strap 22 all of a suitable plastic. The illustrated strap 23 has a pair of strap arms 24 and 26 but it should be understood that the invention contemplates the molding of one more or several other arms having other nozzles at the strap free and depending on the variety of nozzles and spray or discharge patterns being offered to the sprayer owner or user. For example, nozzle 18 will provide a cone discharge pattern while nozzle 20 will provide a fan discharge pattern.

Figure 5:
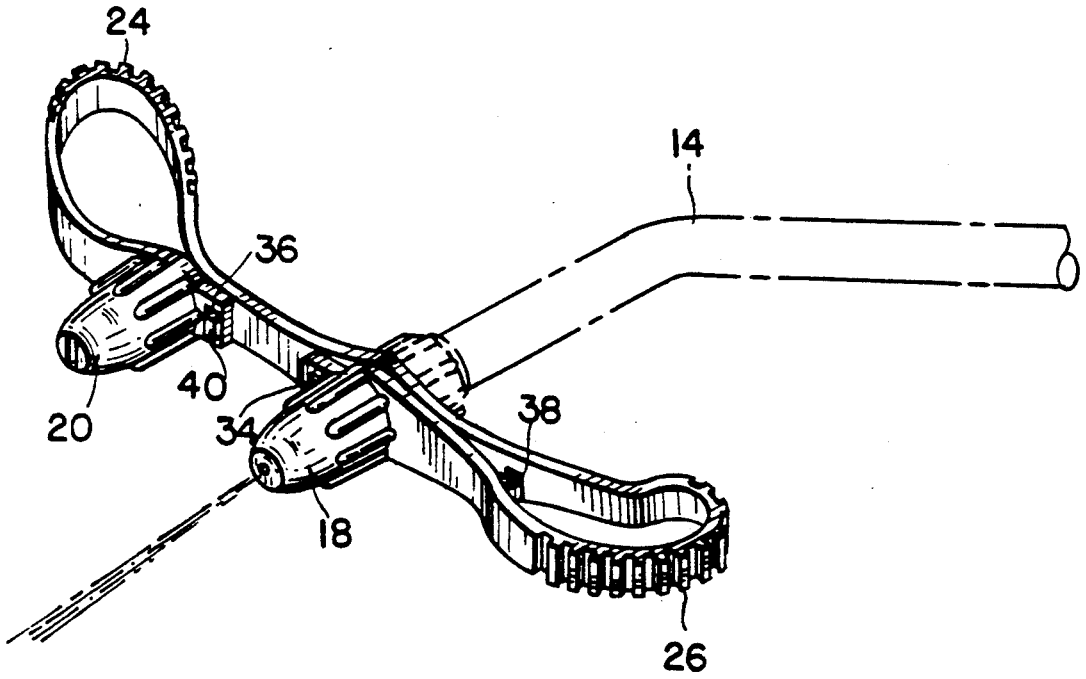
FIG. 5 is a perspective view of the cone spray nozzle coupled with the valve body on the distal discharge end of an extension tube (shown in phantom) with the other nozzle releasably connected with a hook, so that it may be placed out of the way during spraying.

Strap 22 and particularly its arms 24 and 26 are flexi7 ble to permit proper placement of the nozzle. In this regard, the selected nozzle which is internally threaded is adapted to be screwed on to an externally threaded nozzle body 28 at the distal discharge end 12 of the extension tube 14. FIG. 5 shows the nozzle 18 coupled with the nozzle body 28 which is facilitated by the central opening 30 which is adapted be stretched or otherwise placed over the nozzle body 28 against shoulder 32 so that when the nozzle 18 is screwed onto the nozzle body 28 the strap will remain in place on the, discharge end 12 of the extension tube 14. The free end of each strap arm 24 and 26 is provided with slots 34 and 36, respectively. These strap arms are also formed with the respective hooks 38 and 40 which are adapted to be inserted in the strap arm openings so that the nozzle not in use can be releasably secured out of the way of the spraying operation. As shown in FIG. 5, the nozzle 20 has its slot 36 coupled with hook 40. Obviously, when both nozzles are not in use, each may be similarly hooked out of the way.

Figure 6:
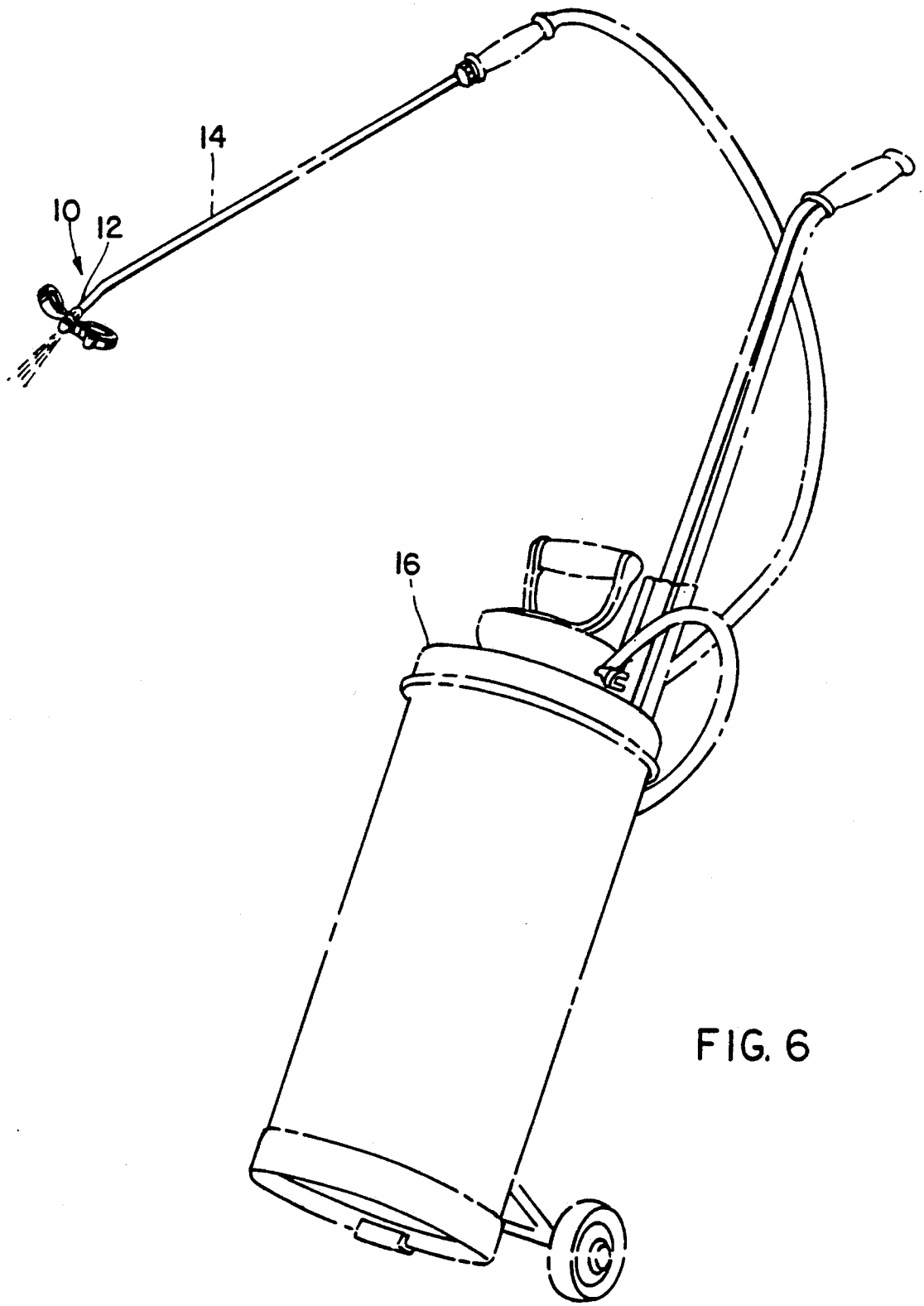
FIG. 6 is a perspective view of the multiple nozzle and strap assembly with the extension and a compression sprayer shown in phantom.

It will be apparent, that the multiple nozzle and strap assembly 10 may form part of the spraying apparatus of FIG. 6 or be offered commercially as an accessory thereto.

The assembly may as previously explained, include two, three or more nozzles on strap arms extending from the center and different angles. The nozzle may offer a variety of discharge patterns so that the user could select the nozzle most appropriate for the particular job. For example, a flat form nozzle and a cone nozzle as illustrated could be selected, or two varying flat form nozzles, or two varying cone nozzles, or two varying splatter nozzles or other orifice sizes as are market appropriate for garden, lawn and related applications, for application of stains, wood sealers, concrete curing compounds and the like. The strap 22, in addition to being flexible, is also fully rotatable around the distal end 12 of the extension tube 14 so as to enable the user to easily fold one of the nozzles and thread this nozzle to the nozzle body 28 and hook the other nozzle out of the way as shown in FIG. 5.

Thus, the several aforenoted objects and advantages are more effectively attained. Although a single somewhat preferred embodiment had been disclosed and described in detail herein, it should be understood that the invention is in no sense limited thereby and its scope is to be determined by that of the appended claims.

I claim:

1. A multiple nozzle and strap assembly for coupling with a nozzle body of a sprayer comprising:

a flexible strap having a central portion and at least two strap arms extending outwardly from the central portion, an opening in the central portion for receiving the nozzle body; each strap arm having an outer free end; and a nozzle on each of the strap arm free ends for coupling with the nozzle body for obtaining a selected discharge pattern, each nozzle is different and provides a different discharge pattern.

2. The invention in accordance with claim 1 wherein the strap and nozzles are integrally molded.

3. A multiple nozzle and strap assembly for coupling with a nozzle body of a sprayer comprising:

a flexible strap having a central portion and at least two strap arms extending outwardly from the central portion, an opening in the central portion for receiving the nozzle body; each strap arm having an outer free end; and a nozzle on each of the strap arm free ends for coupling with the nozzle body for obtaining a selected discharge pattern, each strap arm including a hook and a slot formed at each strap arm free end whereby when the nozzle is not on the nozzle body, it is placed out of the way by bending the strap arm having this nozzle and hooking the hook in the slot of this strap arm.

4. A multiple nozzle and strap assembly for coupling with a nozzle body of a sprayer comprising:

a flexible strap having a central portion and at least two strap arms extending outwardly from the central portion, an opening in the central portion for receiving the nozzle body; each strap arm having an outer free end; and a nozzle on each of the strap arm free ends for coupling with the nozzle body for obtaining a selected discharge pattern, the strap and nozzles being integrally molded, each nozzle being different and providing a different discharge pattern, and each strap arm including a hook and a slot formed at each strap arm free end whereby when the nozzle is not on the nozzle body, it is placed out of the way by bending the strap arm having this nozzle and hooking the hook in the slot of this strap arm.

5. A sprayer having an extension tube having a free end, a nozzle body on the extension tube free end, a multiple nozzle and strap assembly coupled with the nozzle body, the assembly comprising:

a flexible strap having a central portion and at least two strap arms extending outwardly from the central portion, an opening in the central portion for receiving the nozzle body; each strap arm having an outer free end; and a nozzle on each of the strap arm free ends for coupling with the nozzle body for obtaining a selected discharge pattern.

6. The invention in accordance with claim 5 wherein the opening in the central portion of the strap and the nozzle body are so constructed and arranged such that the strap is freely rotatable on the nozzle body.

7. The invention in accordance with claim 6 wherein the strap and nozzles are integrally molded, each nozzle is different and provides a different discharge pattern, and a hook and a slot is formed at each strap arm free end whereby when the nozzle is not on the nozzle body, it is placed out of the way by bending the strap arm having this nozzle and hooking the hook in the slot of this strap arm.

8. The invention in accordance with claim 5 wherein each strap arm includes a hook and a slot formed at each strap arm free end whereby when a nozzle is not on the nozzle body, it is placed out of the way by bending the strap arm having this nozzle and hooking the hook in the slot of this strap arm.

9. The invention in accordance with claim 5 wherein the strap and nozzles are integrally molded and each nozzle is different and provides a different discharge pattern.

10. A nozzle and strap assembly for coupling with a nozzle body of a sprayer comprising:

a flexible strap having a nozzle body receiving portion and strap arm means extending outwardly from the receiving portion, an opening in the receiving portion for receiving the nozzle body; and at least two nozzles on the strap arm means for coupling with the nozzle body for obtaining selected discharge patterns, the strap and nozzles being integrally molded and each nozzle being different and providing a different discharge pattern.

11. A sprayer having an extension tube having a free end, a nozzle body on the extension tube free end, a nozzle and strap assembly coupled with the nozzle body, the assembly comprising:

a flexible strap having a nozzle receiving portion and strap arm means extending outwardly from the receiving portion, an opening in the receiving portion for receiving the nozzle body; and at least two nozzles on the strap arm means for coupling with the nozzle body for obtaining selected discharge patterns, the strap and nozzles being integrally molded and each nozzle is different and provides a different discharge pattern.

12. The invention in accordance with claim 11 wherein the opening in the receiving portion of the strap and the nozzle body are so constructed and arranged such that the strap is freely rotatable on the nozzle body.

* * * * *